United States Patent [19]

Weirich et al.

[11] 4,169,689

[45] Oct. 2, 1979

[54] TENSIONING A LONGWALL MINERAL MINING INSTALLATION

[75] Inventors: Walter Weirich, Dortmund; Michael Dettmers, Kamen; Christoph Rassmann, Lunen; Willi Heyer, Bochum-Gerthe; Herbert Beyer, Werne; Horst Linke, Lunen, all of Fed. Rep. of Germany

[73] Assignee: Gewerkschaft Eisenhutte Westfalia, Lunen, Fed. Rep. of Germany

[21] Appl. No.: 889,076

[22] Filed: Mar. 22, 1978

[30] Foreign Application Priority Data

Mar. 22, 1977 [DE] Fed. Rep. of Germany ..... 2712388

[51] Int. Cl.[2] ..... E21D 15/44

[52] U.S. Cl. ..... 405/291

[58] Field of Search ..... 61/45 D; 299/31-33; 91/170 MP

[56] References Cited

U.S. PATENT DOCUMENTS

| | | | |
|---|---|---|---|
| 3,072,241 | 1/1963 | Rosenberg et al. | 61/45 D X |
| 3,159,003 | 12/1964 | Kearsley | 61/45 D |
| 3,447,328 | 6/1969 | Schuerman | 61/45 D |
| 3,691,775 | 9/1972 | Holtrup et al. | 61/45 D |
| 3,726,097 | 4/1973 | Linke et al. | 61/45 D |

*Primary Examiner*—Dennis L. Taylor

*Attorney, Agent, or Firm*—Sughrue, Rothwell, Mion, Zinn and Macpeak

[57] ABSTRACT

Mining apparatus comprises a longwall conveyor and tensioning means for tensioning the conveyor in its longitudinal direction. The tensioning means is constituted by a plurality of hydraulic tensioning rams, each of which is mounted, in use, by means of pivot joints at each end thereof directly between the conveyor and a respective roof support unit of a roof support assembly. Each tensioning ram extends at an acute angle to the longitudinal axis of the conveyor. The tensioning rams are positioned in two groups, one in each end zone of the conveyor.

29 Claims, 5 Drawing Figures

TENSIONING A LONGWALL MINERAL MINING INSTALLATION

BACKGROUND OF THE INVENTION

This invention relates to means for tensioning a mineral mining installation such as a longwall conveyor.

Known forms of tensioning apparatus suffer from the disadvantage of being constructionally complicated and expensive, arising from the use of a large number of tensioning rams and/or the use of special beams and guides for supporting the tensioning rams. Moreover, the known forms of tensioning apparatus lead to difficulties during the advance of the conveyor. Typical examples of such tensioning apparatus are described in DT-PS No. 1298071, DT-OS No. 2059471, DT-OS No. 2146811 and DT-AS No. 1932378.

The aim of the invention is to provide a tensioning means for a mineral mining installation such as a longwall conveyor, which means does not suffer from these disadvantages.

SUMMARY OF THE INVENTION

The present invention provides a mining apparatus comprising a longwall mineral mining installation and tensioning means for tensioning the installation in its longitudinal direction, the tensioning means being constituted by a plurality of hydraulic tensioning rams, each of which is mounted, in use by means of attachment joints at each end thereof directly between the installation and a respective roof support unit of a roof support assembly, each tensioning ram extending at an acute angle to the longitudinal axis of the installation, wherein the tensioning rams are positioned in two groups, one in each end zone of the installation.

Advantageously, each of the attachment joints of each tensioning ram is a pivot joint. By arranging the axes of the pivot joints to be substantially perpendicular to the floor of the mine working, the tensioning rams can pivot slightly in a plane parallel to that of the floor. This permits the tensioning rams to take up different positions during the advance of the installation or in the follow-up of the roof support units. Since no special beams and guides are required for supporting the tensioning rams, and since the rams are provided only at the ends of the installation, this apparatus is considerably less complicated and expensive than known forms of apparatus. Moreover, this simplified construction reduces the difficulties associated with the advance of the installation and/or the roof support assembly.

Each tensioning ram may lie substantially parallel to the other tensioning rams in that group, and the axis of each tensioning ram may point towards the adjacent end of the installation.

Alternatively, the tensioning rams of each group may be so positioned that the axes of each pair of adjacent tensioning rams are directed one towards and one away from the adjacent end of the installation. In this case, one ram of each pair is pressurised in the direction tending to extend that ram, and the other ram of that pair is pressurised in the direction tending to retract that other ram. Thus both rams of that pair act to tension the installation, but the force components of the rams at right-angles to the installation cancel each other out.

Preferably the installation is a longwall conveyor constituted by a plurality of channel sections joined end-to-end. In this case, the provision of tensioning rams only at the ends of the conveyor, has the advantage that the articulatedly interconnected conveyor channel sections maintain their articulate mobility over the major part of the length of the conveyor (that is to say over the entire length between the two groups of tensioning rams.)

Where the tensioning rams in each group are substantially parallel, each tensioning ram may be attached to a respective conveyor channel section. In the alternative arrangement of the tensioning rams, a pair of adjacent rams may be attached to each end channel section of the conveyor. In the former case, instead of attaching the tensioning rams to the individual channel sections, each tensioning ram may be attached to a respective coupling member which connects two adjacent conveyor channel sections together. It is also possible for each tensioning ram to be attached to a rigid beam which acts to connect two adjacent conveyor channel sections rigidly together.

Advantageously, each tensioning ram adjacent to an end of the installation has a longer working stroke than the other tensioning rams in that group, and each connector channel section is provided with a plurality of longitudinally spaced attachment points for the associated longer working stroke tensioning ram. This permits the distance by which a drive station extends into a roadway at the end of the working, to be varied. This variation can be improved by fitting longer or shorter connector channel sections. Moreover, a certain compensation is possible for any slip that might occur of the entire apparatus in the direction of dip of the working.

The apparatus may further comprise a roof support assembly constituted by a plurality of roof support units positioned side-by-side on the goaf side of the installation, the units at the ends of the assembly being attached to the tensioning rams.

Where the tensioning rams in each group are substantially parallel, each tensioning ram may be attached to a respective roof support unit. In the alternative arrangement of the rams, each pair of adjacent tensioning rams may be attached to a respective roof support unit.

Advantageously, each roof support unit has a floor sill constituted by two spaced floor girders. In this case, where each roof support unit is attached to two tensioning rams, the pair of tensioning rams associated with a given roof support unit may be attached one to each floor girder. The tensioning rams associated with a given roof support unit may converge or diverge from that unit towards the installation.

Preferably, each roof support unit is provided with a double-acting hydraulic advance ram coupled to the installation for advancing the installation in a direction at right-angles to its longitudinal axis, and for advancing that unit in a follow-up sequence.

The apparatus may further comprise control means for automatically relieving the tensioning rams as the roof support units are advanced in a direction at right-angles to the longitudinal axis of the installation.

Advantageously, the control means is constituted by a plurality of control devices each of which is associated with a respective tensioning ram, and each of which has a check valve for relieving the associated tensioning ram. Each check valve may be operated by a servo-piston upon initiation of advance movement of the associated roof support unit. Preferably, each servo-piston is actuated in dependence upon the pressurisation of the hydraulic advance ram of the associated roof support unit. Alternatively, each servo-piston may be actuated in dependence upon the depressurisation of the hydraulic roof support props of the associated roof support unit.

Preferably, each control device is provided with a control valve having three operating positions, in a first of which the associated tensioning ram is pressurised in a direction tending to extend that ram, in a second of which that ram is pressurised in a direction tending to retract that ram, and in the third of which that ram is isolated from pressurisation in either direction. Each control valve may be a manually operable spool valve.

Advantageously, each tensioning ram is pressurised by means of a metering device. Preferably, a respective metering device is provided for each group of tensioning rams.

The apparatus may further comprise variable pressure-reducing means for varying the pressure of the hydraulic fluid applied to the tensioning rams. Advantageously, the pressure-reducing means is constituted by a pair of variable pressure-reducing valves, each of which is associated with a respective group of tensioning rams.

BRIEF DESCRIPTION OF THE DRAWINGS

A longwall conveyor with tensioning apparatus constructed in accordance with the invention will now be described, by way of example, with reference to the accompanying drawings, in which.

Figure 3:
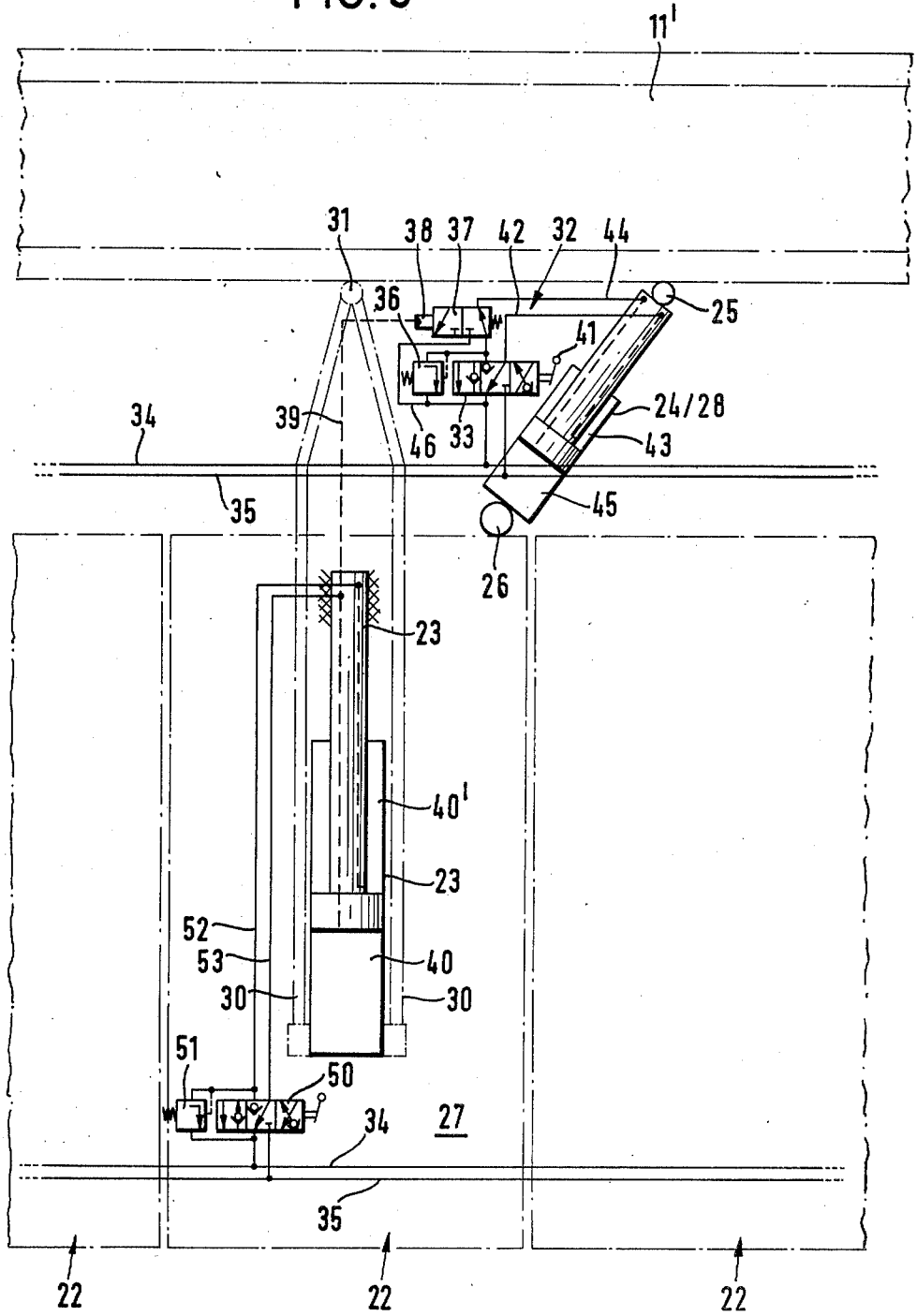
Figure 4:
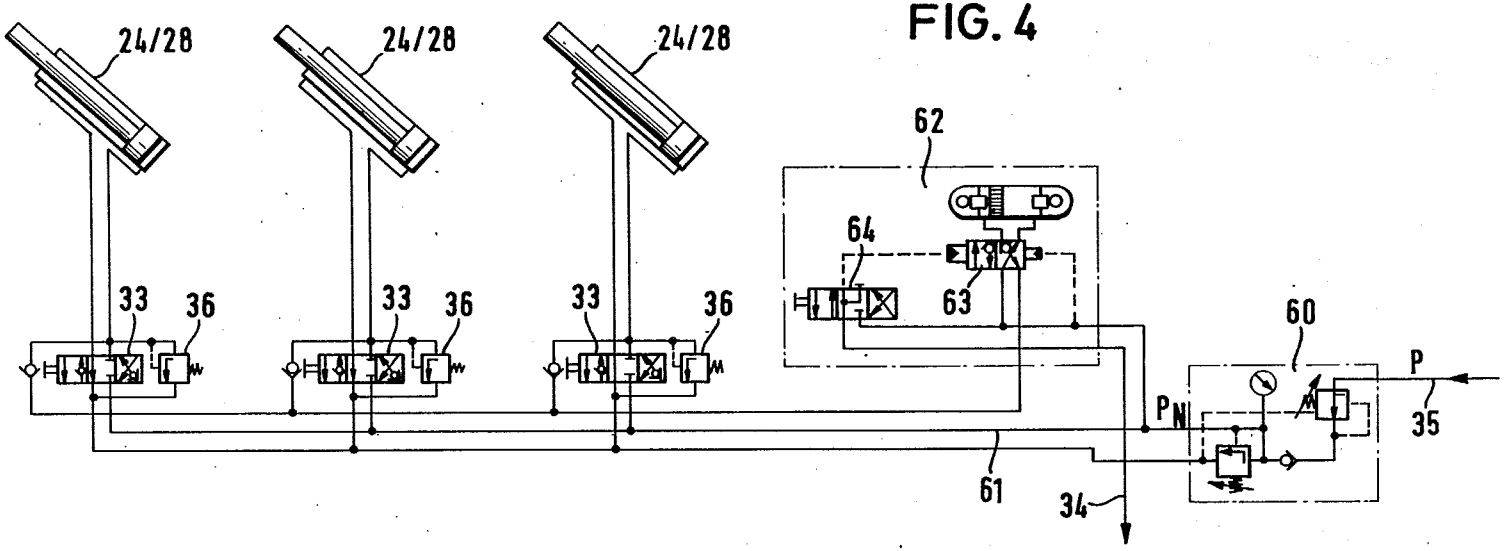

FIGS. *2a* and *2b* are partial plan views of modified forms of tensioning apparatus;

FIG. 3 is a diagrammatic plan view of a single hydraulic tensioning rams together with its control valve arrangement, and FIG. 4 is a diagrammatic plan view of several hydraulic tensioning rams together with their control valve arrangement.

DESCRIPTION OF PREFERRED EMBODIMENT

Figure 1:
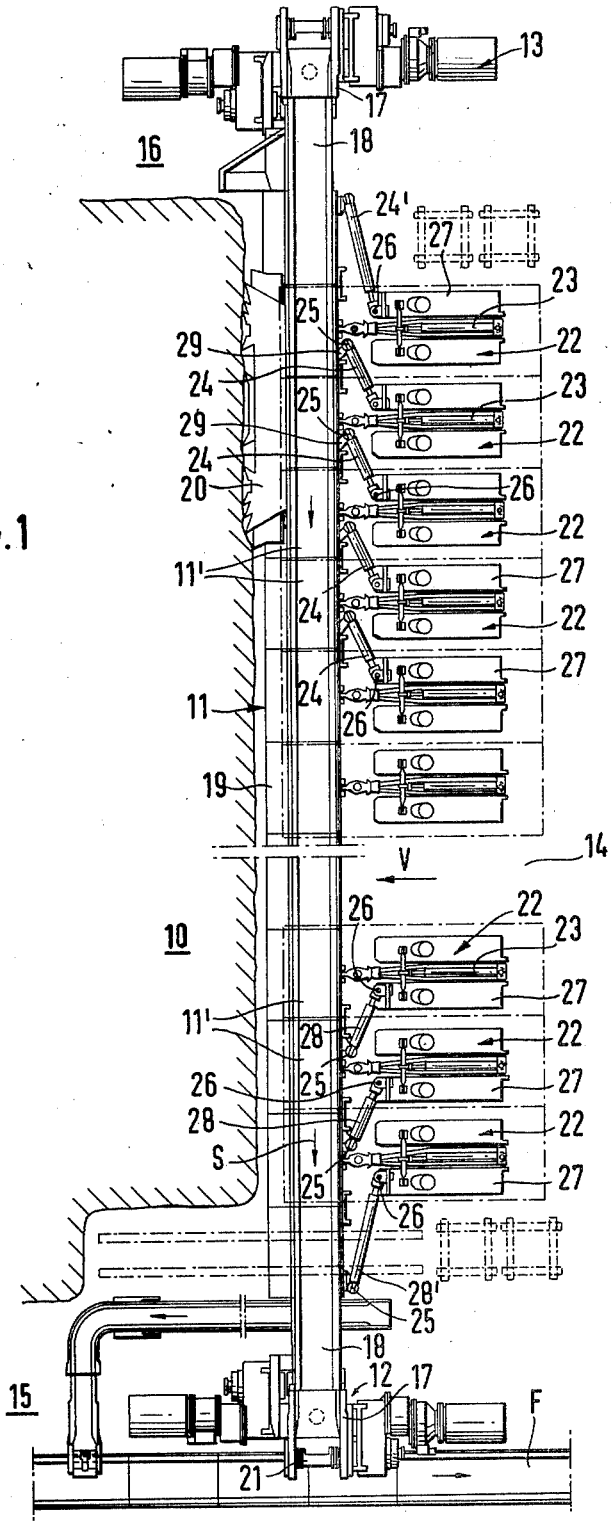
FIG. 1 is a plan view of the longwall conveyor.
Figure 2A:
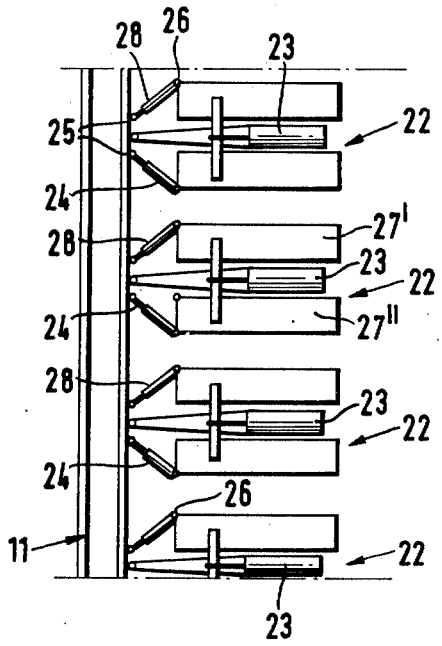
Figure 2B:
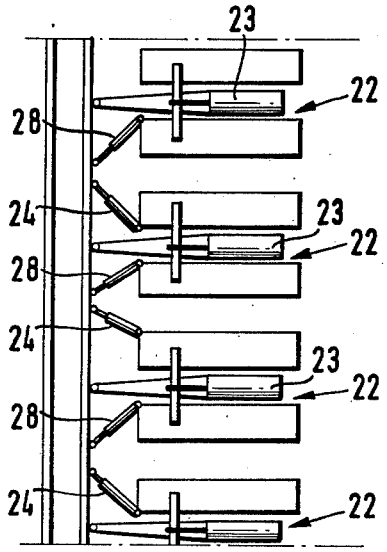

Referring to the drawings, FIG. 1 shows a longwall coal face 10, a longwall conveyor 11 and a longwall working 14. The longwall conveyor 11 is a scraper chain conveyor and is constituted by a plurality of channel sections 11' joined end-to-end. The channel sections 11' are inter-connected in such a manner as to allow a certain amount of angular mobility between adjacent sections. A main drive station 12 is provided at one end of the conveyor 11, an auxiliary drive station 13 being provided at the other end of the conveyor. The main drive station 12 extends from the longwall working 14 slightly into a bottom roadway 15. Similarly, the auxiliary drive station 13 extends slightly into a top roadway 16. Each drive station 12 and 13 is connected to the adjacent conveyor channel section 11' by means of a respective connector section 18.

The face side of the longwall conveyor 11 is provided with a guide 19 along which a swordless plough 20 is driven by an endless chain (not shown). The plough 20 wins coal in both directions of travel along the guide 19, the won coal being directed onto the conveyor 11 where it is conveyed, in the direction of the arrow S, by a scraper-chain assembly (not shown) which circulates along the channel sections 11'. The coal is discharged over a chain drum 21 which drives the scraper-chain assembly and which is mounted between the side plates of the drive frame 17 of the main drive station 12. This discharged coal is then transported away along a conveyor F situated in the roadway 15.

The roof of the longwall working 14 is supported by means of a mine roof support assembly constituted by a plurality of mine roof support units 22 positioned side-by-side along the conveyor 11. Each unit 22 is coupled to a corresponding channel section 11' of the conveyor 11 by means of a respective double-acting hydraulic advance ram 23. The channel sections 11' of the conveyor can, therefore, be advanced successively and incrementally by extending the rams 23. The roof support units 22 can then be advanced, in follow-up sequence, by retracting the rams 23.

The longwall conveyor 11 is tensioned by means of respective sets of hydraulic tensioning rams situated at the two ends of the conveyor, the roof support units 22 at the ends forming abutments for the tensioning rams. Thus, tensioning is effected at the top roadway end of the conveyor 11 by means of hydraulic tensioning rams 24, the cylinder of each of which is attached by means of a pivot joint 25 to the goaf side of the conveyor, and the piston rod of each of which is attached by means of a pivot joint 26 to the floor sill 27 of one of the roof support units 22. The pivot joints 25 and 26 have pivot axes which lie at right-angles to the floor of the working 14 so that the rams 24 can pivot in a plane parallel to that of the floor. As can be seen from FIG. 1, each ram 24 is arranged so that its axis lies at an acute angle to the longitudinal axis of the conveyor 11. Moreover, each ram 24 is attached to a respective individual roof support unit 22 and to a respective individual channel section 11' of the conveyor 11. There are five tensioning rams at the top roadway end of the conveyor 11, the end ram 24' having a considerably longer working stroke than the other four rams 24. The cylinder of this long working stroke ram 24' is attached to the connector section 18.

At the other end of the conveyor 11, the tensioning is effected by means of hydraulic tensioning rams 28. These rams 28 are similar to the rams 24, the cylinder of each being attached by means of a pivot joint 25 to the goaf side of the conveyor 11, and the piston rod of each being attached by means of a pivot joint 26 to the floor sill 27 of one of the roof support units 22. Here again, the pivot joints 25 and 26 have pivot axes which lie at right-angles to the floor of the working 19 so that the rams 28 can pivot in a plane parallel to that of the floor. Again, each of the rams 28 is positioned at an acute angle to the longitudinal axis of the conveyor 11 and each ram is attached to a respective individual channel section 11' and to a respective individual roof support unit 22. However, at this end of the conveyor 11, there are only three tensioning rams, the end ram 28' having a considerably longer working stroke than the other two rams 28. The cylinder of this ram 28' is attached to the connector section 18.

As can be seen from FIG. 1, the rams 28, 28' are inclined opposite to the rams 24, 24'. Thus, the rams 24, 24' tension the conveyor 11 towards the top roadway 16, and the rams 28, 28' tension the conveyor towards the bottom roadway 15, that is to say in the direction of the arrow S.

By positioning the rams 24, 24' and 28, 28' at relatively small acute angles to the longitudinal axis of the conveyor 11, these rams exert a relatively large force component along the axis of the conveyor, and a relatively small force component at right-angles thereto that is to say in the direction V of conveyor advance. Moreover, where the floor of the working 14 dips in the direction of the arrow S, the forces acting in this direction arising from the chain traction forces driving the conveyor 11 and/or the plough 20, tend to pivot the ram 24, 24' about their pivot joints 26 so as to provide an additional force component in the direction of the arrow V. Similarly, the rams 28, 28' tend to pivot about their pivot joints 26 so as to provide an additional force component in the opposite direction to that of the arrow V.

Where the floor of the working 14 dips considerably, it is necessary to tension the conveyor by a greater amount in the direction opposed to that of the dip, and it is for this reason that the embodiment of FIG. 1 has five rams 24, 24' at the top roadway end and only three rams 28, 28' at the bottom roadway end.

Each of the tensioning rams 24 and 28 is attached to the corresponding channel section 11' of the conveyor 11 by means of a respective connector 29 which also forms part of the associated pivot joint 25. Instead of being fixed to an individual channel section 11', each connector 29 could be fixed to a respective coupling member which interconnects adjacent channel sections. It is also possible to fix the connector 29 to stiffening elements such as rigid beams which in some cases may be used to connect the end channel sections 11' of the conveyor together in a rigid manner.

The provision of the long working stroke tensioning rams 24' and 28' enables the positions of the drive stations 12 and 13 to be adjusted within a given range. In order to facilitate this adjustment, it is advisable to provide a series of longitudinally spaced connectors (such as the connectors 29) on each of the connector sections 18. Moreover, this range of adjustment can be varied by utilising connector sections 18 of different lengths. Whilst a connector section 18 is being changed, the short-stroke rams 24 or 28 hold the conveyor 11 in position.

FIGS. *2a* and *2b* show modified arrangements of the tensioning rams 24 and 28. Thus, FIG. *2a* shows one end of a longwall working, in which each roof support unit 22 is provided with two tensioning rams 24 and 28 whose axes are inclined at acute angles to the longitudinal axis of the conveyor 11 and converge towards the conveyor. The piston rod of each of the rams 24 and 28 is attached to the conveyor 11 by means of a respective pivot joint 25, and the cylinder of each of these rams is attached to the associated roof support unit by means of a respective pivot joint 26. In this case, the floor sill of each roof support unit is formed by a pair of floor girders 27' and 27'', each of which is attached to one of the two rams 24 and 28 associated with that unit. Each of the rams 24 is pressurised with hyraulic fluid in a direction tending to extend that ram, and each of the rams 28 is pressurised in a direction tending to retract that ram. Thus, both the rams 24 and 28 of each pair of rams associated with a particular roof support unit 22 act to tension the conveyor 11 towards the adjacent end thereof. Moreover, the force components of the rams 24 and 28 of each pair in the direction of the arrow V cancel one another out, so that the only resultant forces acting on the conveyor act to tension the conveyor.

The embodiment of FIG. *2b* is very similar to that of FIG. *2a*, except that the two rams 24 and 28 of each pair are attached to adjacent roof support units 22. Each roof support unit 22 is provided, in the embodiment of both FIGS. *2a* and *2b*, with a hydraulic advance ram 23.

FIG. 3 shows a hydraulic control arrangement for a single hydraulic tensioning ram 24 or 28 of any one of the embodiments described above. FIG. 3 also shows one of the hydraulic advance rams 23 whose piston rod 23' bears against the associated roof support unit 22, and whose cylinder bears against one end of each of a pair of guide rods 30 whose other ends are attached, via a joint 31, to the associated conveyor channel section 11'. A control unit 32 is associated with the tensioning ram 24/28, this control unit including a control valve 33 which is connected on the inlet side, to hydraulic return and pressure lines 34 and 35 respectively. These lines 34 and 35 are laid alongside the conveyor 11 and are connected to all of the control units of the other tensioning rams. The control unit 32 is also provided with a pressure relief valve 36 and a servo-activated check valve 37 (a 3/2 way valve), the servo piston 38 of which is controlled, via a control conduit 39, by the pressure of the hydraulic fluid in a chamber of the advance ram 23. The outlet side of the control valve 33 is connected, via a conduit 42, to an annular working chamber 43 of the tensioning ram 24/28, and, via a conduit 44, to a cylindrical working chamber 45 of that tensioning ram. The control valve 33, which is conveniently a spool valve, may be manually actuated by means of a hand lever 41. The control valve 33 has three operating positions, in a first of which the working chamber 43 of the tensioning ram 24/28 is connected to the pressure line 35 and the working chamber 45 is connected to the return line 34, in the second of which the working chamber 45 is connected to the pressure line 35 and the working chamber 43 is connected to the return line 34, and in the third of which both working chambers 43 and 45 are connected to the return line 34.

The hydraulic advance ram 23 is provided with a manually actuated control valve 50 and a pressure relief valve 51. These valves 50 and 51 lie in conduits 52 and 53 which connect the two working chambers 40 and 40' of the hydraulic advance ram 23 respectively with the pressure line 35 and the return line 34.

In the position shown in FIG. 3, both the working chambers 43 and 45 of the tensioning ram 24/28 are connected to the return line 34, that is to say the valve is in its third position. Thus, the working chamber 43 is connected to the return line 34 via the control valve 33, and the working chamber 45 is connected to the return line 34 via the check valve 37 and the pressure-relief valve 36. In this position, therefore, the tensioning ram 24/28 is isolated or blocked from the pressure line 35 so that its piston rod can move relatively freely within its cylinder. In order to supply the working chamber 45 with hydraulic fluid under pressure and so extend the ram 24/28, the control valve is moved into its second position, the pressure line 35 then being in communication with the working chamber 45 via the control valve 33, the check valve 37 and the conduit 44. In this position, the working chamber 43 is connected to the return line 34 via the conduit 42 and the control valve 33. In order to retract the ram 24/28, the control valve is moved to its first position, in which the working chamber 43 is connected to the pressure line 35 via the conduit 42 and the control valve 33, and the working chamber 45 is connected to the return line 34 via the conduit 44, the check valve 37 and the control valve 33.

If the associated roof support unit 22 is to be advanced, the working chamber 40 of the hydraulic advance ram 23 is pressurised by actuation of the control valve 50. Since the working chamber 40 is connected to the servo piston 38 of the check valve 37 via the control conduit 39, this causes an increase in the hydraulic pressure acting on the servo piston which moves inwardly to change the position of the check valve 37. The check valve 37 then connects the conduit 44 to a secondary conduit 46 which by-passes the control valve 33 and leads directly to the return line 34. Thus, the working chamber 45 of the tensioning ram 24/28 is relieved so that this ram can retract as the associated roof support unit is advanced to follow up the advance of the conveyor. Moreover, the circuit arrangement is such that, as long as the check valve 37 is held in this position, the working chamber 45 of the tensioning ram 24/28 is connected to the return line 34 and so is blocked against the entry of pressurised fluid. As soon as the roof support unit 22 has been fully advanced, the working chamber 40 of its advance ram 23 is relieved of pressure, and the check valve 37 is returned into its normal working position (this is to say the position shown in FIG. 3) by a return spring, so that the working chamber 45 of the tensioning ram 24/28 can be subject to pressurised hydraulic fluid by appropriate positioning of the control valve 33.

FIG. 4 shows a hydraulic control system for one set of tensioning rams 24/28, each ram being provided with a respective control valve 33 and a respective pressure relief valve 36. A variable pressure reducing valve 60 is provided for the set of rams 24/28, the valve 60 acting to reduce the high pressure P in the pressure line 35 to a lower working pressure $P_N$ in a conduit 61 which forms an input to each of the control valves 33, it is possible to adjust the working pressure applied to the tensioning rams 24/28 independently of the pressure applied to the advance rams 23, and to adapt the force with which the conveyor 11 is pressed against the longwall face 10 and the tensioning forces to actual operating conditions.

The control system of FIG. 4 also includes a known type of metering device for applying pressurised hydraulic fluid to the tensioning rams 24/28 in metered amounts. This metering device comprises a metering cylinder 62 provided with appropriate control valves 63 and 64, with which the individual tensioning rams 24/28 can be pressurised with metered quantities of fluid. Thus, the advance of the conveyor 11 can be regulated without the danger that the tensioning rams 24/28 become ineffective owing to the forces exerted by the advance rams 23.

Although the control system of FIG. 4 does not utilise servo-controlled check valves 37, the system could be modified to include such valves Moreover, the servo-controlled check valves 37, where provided, could be connected, via these control conduits 39, to the hydraulic props of the associated roof support unit 22, so that they can be changed over in dependence upon the pressurisation of these props.

We claim:

1. A mining apparatus, comprising:

(a) a longitudinally oriented longwall mineral mining installation, (b) a longitudinally oriented roof support assembly disposed adjacent and generally parallel to said installation, said roof support assembly comprising a plurality of roof support units, (c) means for longitudinally tensioning the installation comprising two groups of hydraulic tensioning rams, each group being disposed at a respective end zone of the installation, and (d) a plurality of attachment joints individually mounting the ends of each hydraulic tensioning ram directly between the installation and a respective roof support unit with each ram lying at an acute angle to the longitudinal axis of the installation, whereby the selected and controlled extension of the rams serves to longitudinally tension the installation.

2. Apparatus according to claim 1, wherein each of the attachment joints of each tensioning ram is a pivot joint.

3. Apparatus according to claim 1, wherein each tensioning ram lies substantially parallel to the other tensioning rams in that group.

4. Apparatus according to claim 3, wherein the axis of each tensioning ram points towards the adjacent end of the installation.

5. Apparatus according to claim 1, wherein the tensioning rams of each group are so positioned that the axes of each pair of adjacent tensioning rams are directed one towards and one away from the adjacent end of the installation.

6. Apparatus according to claim 3 or 5, wherein the installation is a longwall conveyor constituted by a plurality of channel sections joined end-to-end.

7. Apparatus according to claim 6, wherein each tensioning ram is attached to a respective conveyor channel section.

8. Apparatus according to claim 6, wherein a pair of adjacent tensioning rams are attached to each end channel section of the conveyor.

9. Apparatus according to claim 6, wherein each tensioning ram adjacent to an end of the conveyor has a longer working stroke than the other tensioning rams in that group.

10. Apparatus according to claim 9, wherein each of the longer working stroke tensioning rams is attached to a connector channel section which, connects the conveyor to a drive station.

11. Apparatus according to claim 7, further comprising a roof support assembly constituted by a plurality of roof support units positioned side-by-side of the goaf side of the conveyor, the units at the ends of the assembly being attached to the tensioning rams.

12. Apparatus according to claim 11, wherein each pair of adjacent tensioning rams are attached to a respective roof support unit.

13. Apparatus according to claim 12, wherein each roof support unit has a floor sill constituted by two spaced floor girders.

14. Apparatus according to claim 13, wherein the pair of tensioning rams associated with a given roof support unit are attached one of each floor girder.

15. Apparatus according to claim 14, wherein the tensioning rams associated with a given roof support unit converge from that unit towards the conveyor.

16. Apparatus according to claim 14, wherein the tensioning rams associated with a given roof support unit diverge from that unit towards the conveyor.

17. Apparatus according to claim 11, wherein each roof support unit is provided with a double-acting hydraulic advance ram coupled to the installation for advancing the installation in a direction at right-angles to its longitudinal axis, and for advancing that unit in a follow-up sequence.

18. Apparatus according to claim 1, further comprising control means for automatically relieving the tensioning rams as the associated roof support units are advanced in a direction at right-angles to the longitudinal axis of the installation.

19. Apparatus according to claim 18, wherein the control means is constituted by a plurality of control devices each of which is associated with a respective tensioning ram, and each of which has a check valve for relieving the associated tensioning ram.

20. Apparatus according to claim 19, further comprising a servo-piston for operating each check valve upon initiation of advance movement of the associated roof support unit.

21. Apparatus according to claim 20, further comprising means for actuating each servo-piston in dependence upon the pressurisation of a hydraulic advance ram of the associated roof support unit.

22. Apparatus according to claim 20, further comprising means for actuating each servo-piston in dependence upon the depressurisation of hydraulic roof support props of the associated roof support unit.

23. Apparatus according to claim 19, wherein each control device is provided with a control valve having three operating positions, in a first of which the associated tensioning ram is pressurised in a direction tending to extend that ram, in a second of which that ram is pressurised in a direction tending to retract that ram, and in the third of which that ram is isolated from pressurisation in either direction.

24. Apparatus according to claim 23, wherein each control valve is a manually operable spool valve.

25. Apparatus according to claim 1, wherein each tensioning ram is pressurised by means of a metering device.

26. Apparatus according to claim 25, wherein a respective metering device is provided for each group of tensioning rams.

27. Apparatus according to claim 1, further comprising variable pressure-reducing means for varying the pressure of the hydraulic fluid applied to the tensioning rams.

28. Apparatus according to claim 27, wherein the pressure-reducing means is constituted by a pair of variable pressure-reducing valve, each of which is associated with a respective group of tensioning rams.

29. Mining apparatus for use in a longwall working, the apparatus comprising: a longitudinally oriented longwall conveyor including a plurality of channel sections joined end to end, a roof support assembly including a plurality of roof suport units positioned side-by-side along the goaf side of the conveyor, and tensioning means positioned in two groups, one in each end zone of the conveyor, for tensioning the conveyor in its longitudinal direction, said tensioning means comprising a plurality of hydraulic tensioning rams, a plurality of pivot joints individually mounting the ends of each ram directly between the conveyor and a respective roof support unit, the axes of the pivot joints extending substantially at right-angles to the floor of the working, and each tensioning ram extending at an acute angle to the longitudinal axis of the conveyor.

* * * * *